US010029139B2

(12) United States Patent
Miklósi et al.

(10) Patent No.: US 10,029,139 B2
(45) Date of Patent: Jul. 24, 2018

(54) SPORT EQUIPMENT

(71) Applicant: Sparrowbag Hungary Kft., Budapest (HU)

(72) Inventors: József Miklósi, Budapest (HU); Eszter Babák, Budapest (HU); Károly Füles, Budapest (HU)

(73) Assignee: Sparrowbag Hungary Kft., Budapest (HU)

( * ) Notice: Subject to any disclaimer, the term of this patent is extended or adjusted under 35 U.S.C. 154(b) by 0 days.

(21) Appl. No.: 15/033,279

(22) PCT Filed: Oct. 29, 2014

(86) PCT No.: PCT/HU2014/000099

§ 371 (c)(1),
(2) Date: Apr. 29, 2016

(87) PCT Pub. No.: WO2015/063529

PCT Pub. Date: May 7, 2015

(65) Prior Publication Data

US 2016/0256727 A1 Sep. 8, 2016

(30) Foreign Application Priority Data

Oct. 31, 2013 (HU) ..... 1300626

(51) Int. Cl.
*A63B 21/065* (2006.01)
*A63B 23/02* (2006.01)
(Continued)

(52) U.S. Cl.
CPC ..... *A63B 21/065* (2013.01); *A63B 21/0004* (2013.01); *A63B 21/0601* (2013.01);
(Continued)

(58) Field of Classification Search
CPC ..... A63B 21/06–21/065; A63B 21/00–21/04; A63B 21/40–21/4043; A63B 23/02–23/025; A63B 2225/09
(Continued)

(56) References Cited

U.S. PATENT DOCUMENTS 1,005,791 A * 10/1911 Angell ..... A63B 21/072 482/109
1,432,013 A * 10/1922 Blake ..... A63B 21/0004 482/124

(Continued)

*Primary Examiner* — Garrett Atkinson
(74) *Attorney, Agent, or Firm* — Jason D. Voight

(57) ABSTRACT

The invention relates to a sport equipment, whose primary aspect is endurance training. Another objective of the invention, apart from increasing endurance, is to minimize the risk of injury during and after practices. The invention has a comfortable, tailor-made design shell (1), filled with weight filler (2). The device provides a high degree of freedom to the user, because it does not obstruct the hands and legs while in use. The size of shell (1) is adapted to the user, such that the user can adjust to required size on the neck portion of shell (1), and the equipment takes on an endless shape. Furthermore, by closing the equipment, a 3 dimensional space curve is formed by around the longitudinal axis (4) of human body and the weight filler (2) is placed in sections along the direction of longitudinal axis (4) of equipment.

15 Claims, 5 Drawing Sheets

Figure 1:
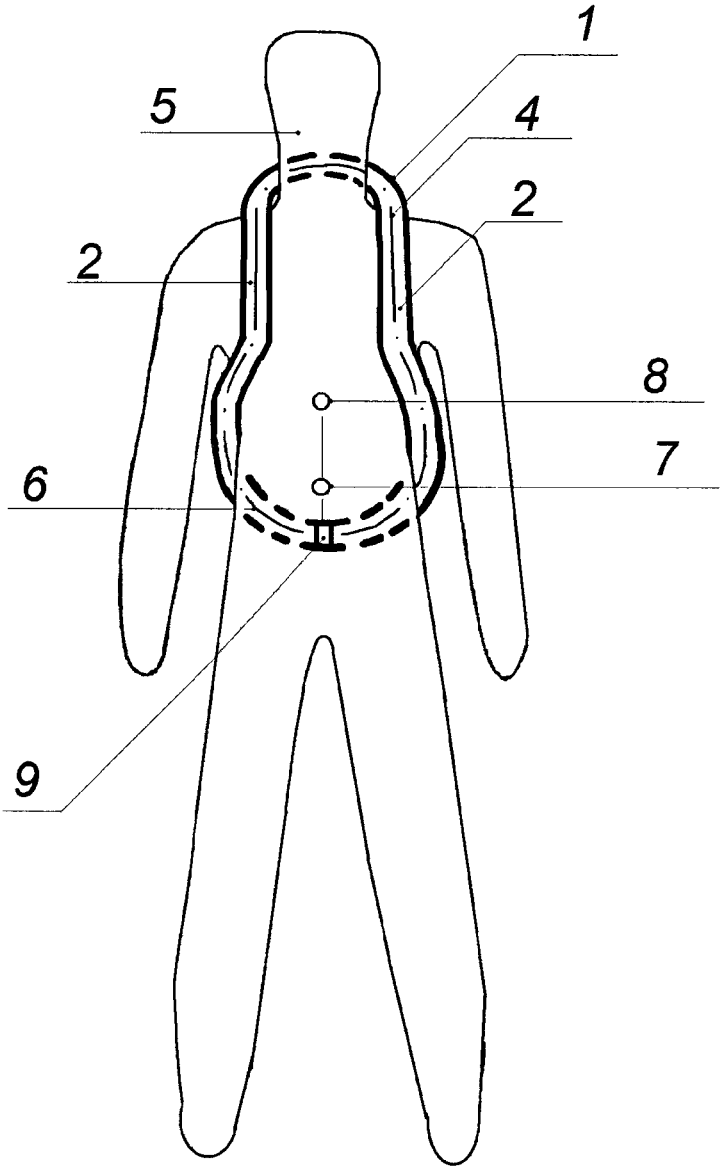

(51) Int. Cl.
*A63B 21/06* (2006.01)
*A63B 21/00* (2006.01)

(52) U.S. Cl.
CPC ..... *A63B 21/0602* (2013.01); *A63B 21/0603* (2013.01); *A63B 21/4003* (2015.10); *A63B 21/4005* (2015.10); *A63B 21/4007* (2015.10); *A63B 21/4025* (2015.10); *A63B 21/4039* (2015.10); *A63B 21/4043* (2015.10); *A63B 23/02* (2013.01); *A63B 2225/09* (2013.01)

(58) Field of Classification Search
USPC ..... 482/91, 92, 105–119
See application file for complete search history.

(56) References Cited

U.S. PATENT DOCUMENTS 2,590,951 A * 4/1952 Farison ..... A63B 21/0004 482/126
3,085,357 A * 4/1963 Nissen ..... A63B 5/16 128/DIG. 15
3,525,141 A * 8/1970 Smith ..... A63B 21/065 29/428
3,655,185 A * 4/1972 Kane ..... A63B 21/0004 422/186.05
3,751,031 A * 8/1973 Yamauchi ..... A63B 21/065 273/DIG. 19
4,090,706 A * 5/1978 Reda ..... A63B 21/0004 482/122
4,239,211 A * 12/1980 Wilkerson ..... A63B 21/065 156/301
4,303,239 A * 12/1981 Walsh, Jr. ..... A63B 21/0603 2/22
4,396,190 A * 8/1983 Wilkerson ..... A63B 21/065 273/DIG. 30
4,540,173 A * 9/1985 Hopkins, Jr. ..... A63B 21/0552 482/124
4,852,874 A * 8/1989 Sleichter, III ..... A63B 21/0004 482/122
4,984,786 A * 1/1991 Lemke ..... A63B 21/4001 482/105
5,065,773 A * 11/1991 Jackson ..... A63B 21/0724 128/876
5,076,575 A * 12/1991 Eylander ..... B63C 11/30 405/186
5,105,804 A * 4/1992 Van Nostrand ..... A61H 37/005 4/573.1
5,122,107 A * 6/1992 Gardner ..... A63B 23/0211 482/140
5,143,057 A * 9/1992 DePasquale ..... A61H 7/001 482/131
5,199,936 A * 4/1993 Moye ..... A63B 21/0004 482/126
5,199,940 A * 4/1993 Morris ..... A61F 5/055 128/845
5,258,018 A * 11/1993 Van Nostrand ..... A61H 37/005 4/573.1
D353,172 S * 12/1994 Gaut ..... D21/692
5,514,059 A * 5/1996 Romney ..... A63B 21/0004 482/121
5,518,481 A * 5/1996 Darkwah ..... A63B 21/0004 482/126
5,711,747 A * 1/1998 Steinback ..... A63B 21/0004 482/122
5,857,948 A * 1/1999 Barnett ..... A63B 21/0004 482/140
5,868,652 A * 2/1999 Spletzer ..... A63B 21/0605 2/22
5,933,874 A * 8/1999 Randolph ..... A41D 13/0518 2/267
5,943,700 A * 8/1999 Hammer ..... A63B 21/0605 2/102
6,182,299 B1 * 2/2001 Chen ..... A41D 13/0518 2/463
6,200,243 B1 * 3/2001 Meranto ..... A63B 21/0602 150/150
6,244,998 B1 * 6/2001 Hinds ..... A63B 21/0004 482/124
6,261,211 B1 * 7/2001 Suarez ..... A63B 21/0603 482/107
6,659,921 B2 * 12/2003 Vernon ..... A63B 21/4025 482/114
7,931,572 B1 * 4/2011 Glauser ..... A63B 21/0004 482/126
8,231,510 B2 * 7/2012 Abdo ..... A63B 21/0004 482/105
D678,434 S * 3/2013 Hughes ..... D21/662
8,419,599 B2 * 4/2013 Seol ..... A43B 5/08 441/129
9,039,574 B2 * 5/2015 Wilson ..... A63B 21/045 482/46
9,526,965 B2 * 12/2016 Gatherer ..... A63B 71/0054
2002/0010058 A1 * 1/2002 Myrick ..... A63B 21/065 482/92
2003/0073549 A1 * 4/2003 Hatch ..... A63B 21/0601 482/92
2005/0137063 A1 * 6/2005 Abdo ..... A63B 21/0004 482/105
2010/0076358 A1 * 3/2010 Richardson ..... A61B 5/103 602/19
2011/0319235 A1 * 12/2011 Garrett ..... A63B 21/00065 482/105

* cited by examiner

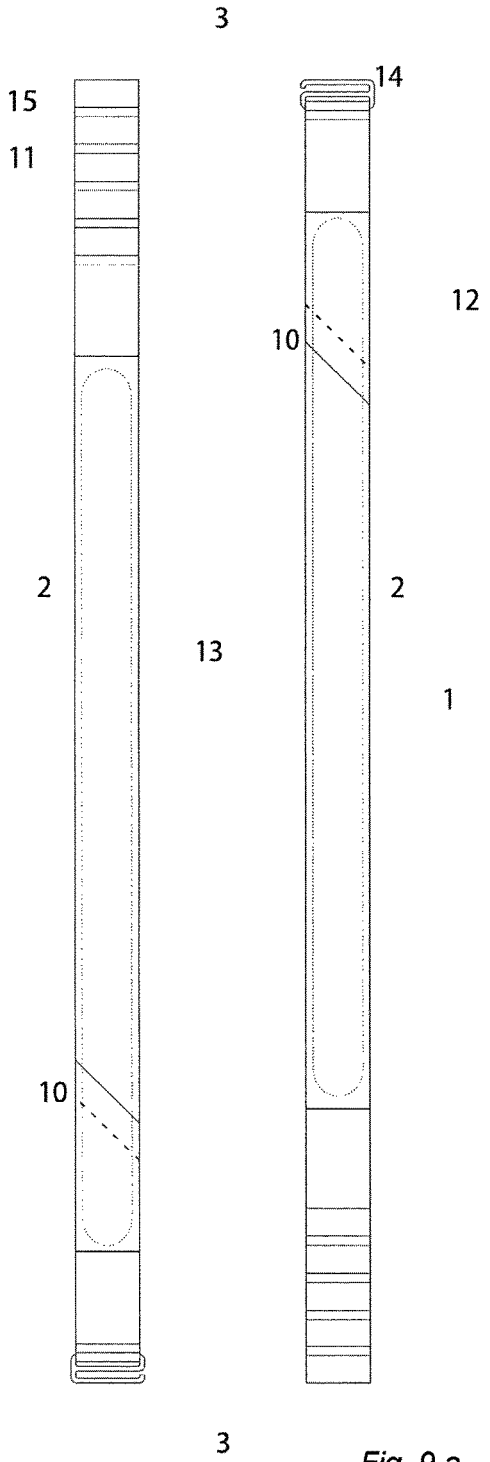
Fig. 9.a
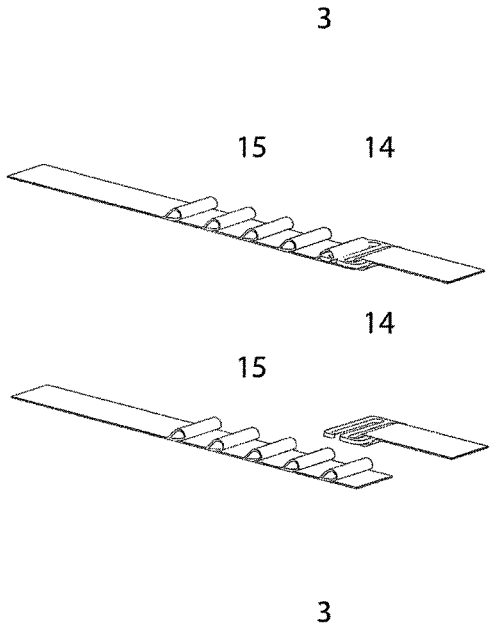
Fig. 9.b

SPORT EQUIPMENT

This is the national stage of International Application PCT/HU2014/000099, filed Oct. 29, 2014.

The invention relates to sport equipment, which is made for increasing and/or maintaining physical fitness. The invention is to be used primarily in the sports, but is not confined to sports, because it can be used in all fields where the aim is to increase, move, repair muscles and to minimize of the damage to muscles. Such a filed may be rehabilitation, skills for developing, improving, such as beneficial influences for balancing, endurancing and body posturing in the growth of children.

The invention is based on the recognition that people do not use every muscle of group with the same intensity and consequent by several muscle groups over develop or regress. It was a special requirement in the development of the tool to eliminate or minimise the direct weight on joints of the limbs. The device provides solution to this problem, namely it can be develop the musclegroups of body which are not used in the ordinarily in a way that they not receive direct weight are joints of the limbs. In addition, the current excess weight equipments are much more uncomfortable and risk injury to the user, furthermore these different devices can be used effectively in just one movementform.

The equipment basically means an extra weight on the body which extra weight is located close to body of normal center of gravity in a way to fit the contours of body (compared to the extra weights located on the limbs), taking notice of the requirements ergonomic particularly comfort and to minimize risk of injury. The equipment fitted to the body contour is more comfortable wearing/feeling for the user even if the weight fillers is not located near to the body is center of gravity, even if for example they are close to the chest or shoulders are located.

There are several devices based on this in prior art, which are used for muscular development. Mentioned among the closest solutions the different weighted vest, whose basic structure is a traditional vest with weight pockets in these could be put different fillers the most often materials such as sand, metal sheets, metal raspings or jelly material. The other equipment group is comprised of hand and leg weights, which are direct burdens on the joints of limbs. All of these types of equipments are limiting the freedom of movement of the user, they can be an uncomfortable wear, risk of injury can be higher and they can be used to only one type of movement. In our opinion, the following sport equipments are the closest to our solution, but these types of equipments do not include these advantageous features, alone or in any combination with each other, which our sport equipment is presents.

The U.S. Pat. No. 5,943,700 A, discloses a weight vest which can be separated to two parts and it can be assembled with a Velcro on the back, the weight fillers can be inserted to the pockets (sections) which are under the armpits. The design shows a simple vest (suggesting an armpit holster), in the same way as the arms have to hide into the vest and the device is held in the defined position by shoulder sections. This design is uncomfortable for user because the weight fillers are directly under the armpit and the weight fillers can be fixed by a strap but just in front of the body especially on the stomach, chest which influences the comfort of device too. The weight fillers are located parallel to each other and they are designed as pockets so that the weight fillers movements are not secured during use. The joint strap is located on the stomach, which allows further injuries. For the basic idea of this prior art device to connect each other with two separate parts, opposite the our solution mean idea is the uniform shape wherein has flexible bond between the weight fillers further and it can be unjoint on two uniform parts and less risk of injury.

WO 2005/063339 A1 discloses a sports device, which has a long-shaped tube and dispose of a weight filler that can be jointed with two fastener at the two ends or thereon configurated two handlers. The device has flexible properties, therefore it can be rolled up on the waist, limbs or fixed, and it can be take on neck as a loop. Into the long-shaped tube can be put different granules, powders as filler. Device does not include weight filler overall and in order to can be locate on the body with some belt lengthening and linking unit which are free and something can be hitched to easily that is more risk of injury as our solution. Another embodiment, which it has not any connection, only have two loops that they function as a handle. The device is not capable to fit the contour of upper body that configures a closed space curve (in vertical axis direction).

In our experiments we found that the most adaptable weight filler of equipment for required function is a material of fluid consistency, which is filled in a flexible shell and these weight filler materials dispose fluid and solid features in the flexible cover of inside of shell for the presented solution. The shell most preferably can be used as a long-shaped bag, but our experiments we have found that the weight filler is not need to be located in entire length of equipment. Preferably the weight filler is configured in several but at least in two parts. The filler of flexible shell, may be sand, different granules, liquids, sawdust, shavings, etc. The weight filler can also be solid object, such as balls, rods, plates, sheets or spongy structure, another possibility is to combine fluid/gel-like material and the solid object, such as a metal ball in a silicone matrix or granule in liquid, stated as examples, but not limiting the scope of the invention. The material of shell should be such that is is impermeable to water (water-resistant) or any liquid in order to keep the solid, fluid structure materials inside the shell. In our experiments, the 3 dimensional elastic property of the material of the shell appeared beneficial, namely that the rate of stretching of the material was different in the 3 spatial directions. At least one part of the equipment is formed with an opening/closing section, which allows the equipment to be in an endless form and surroundings of the opening/closing section do not contain any filler.

The 3 dimensional properties of the material used for the shell were particularly important for cervical section of equipment, also benefiting the comfort and distribution of forces overall during the use of the equipment, but the not limiting the tailorable material (for example: standard textiles, rubber, neoprene, fabric or combinations thereof) of the shell. Furthermore, we noticed that the material of shell itself should be provided with such flexibility which allows for 0-50% stretching between unused and used position. (Advantageous to use these flexible materials when to generate stretching the weight fillers are in the shell during using without so much as get uncomfortable wearing for user) Another benefit of the stretching material is that it allows for the extension of the equipment during use, without distracting the user.

The opening/closing section of shell is adjustable configuration so that the different sized, shaped users can be wearing the equipment. If the two ends of equipment fit in together by opening/closing section that the shape will be endless or continuous such as a loop. The equipment defines/forms in the closed position a 3 dimension space curve along the longitudinal axis of human body. In our experiments we decided to throw out the extra weight at opening/closing section, of course, in this location weight filler with any filler can be formed, but this solution deteriorated/decreased the comfort of wearing equipment.

The shape of equipment is similar to a snake in opened state, in closed state it is similar to a loop or an ellipse and in use it shows a baseball curve (lemniscate) shape and the cervical opening/closing section is formed arc for envelope the radius of which is smaller than the opposite arc for radius of envelope of the cervical opening/closing section. The curve shape in space resembles the sewing on a baseball ball (baseball curve) while wearing, but only similar because the arcs radius of two points are located on th spine of the wearer are not identical (obviously identity is possible). This is obviously due to particularity of the body, for example the circumference of neck, circumference of waist, body height. While using of the equipment, when the user wears it on the upper body, it can be flexible enough to allow that the shape of baseball curve (lemniscate) to fit the contour of upper body or approach to considerably.

Basic concept of the equipment is that when weight is located uniformly on upper body during wearing and the equipments and the wears center of gravity are as close as possible. One of the main functions of equipment that it configures correct posture for the user because the training with correct posture (that is known by in the art) is more effective than improper posture. Appropriately the weight fillers start by the shoulders (shoulder/deltoid muscle) in the direction of the armpits in the interest of correct posture. In our experiments, it was found that preferably the length of equipment is determined so that the part of equipment which is located on back part of user does not extend below the line of the kidneys of the user. With this the comfort can be increased and the risk of injury reduced because this can minimize the unwanted oscillation movement that can be hurt the kidneys. This unwanted movement can be reduced with a bond which is located between the cervical opening/closing portion and the portion of waist (for dismountable design it can connect the two opening/closing points). This bond can be hard (defined length) or flexible. This embodiment is not shown. The weight filler is located in the equipment by sections along the direction of longitudinal axis. The equipment has at least two weight fillers. Preferably, the sport equipment can be separates into two identical or symmetric parts, but also asymmetrical design is possible. The weight fillers are located symmetrically on the body by spinal line, but the location depends on the body shape of user. Of course, different length/size shells must be applied for the different body shape of users. Basically the weight fillers have the same volume furthermore, when the two weight fillers are arranged symmetrically to one and other, they have the same dimensions, but it is possible to apply same and/or different sized weights fillers to the two symmetrically arranged weight fillers. The same technical features apply to the equipment with asymmetrical design as in the case of symmetrical embodiment. For example, opening/closing sections can be located in asymmetric arrangement relative to the spinal line of body.

There are conceivable embodiment of sport equipment, such that, for example there is some flexible joint (for example, rubber, spring) located between the two symmetrical parts whereby the system is still continuous and closed. The result of this solution is that the equipment can be upgraded using additional features with extra functionality, for example for additional absorption of movement of weight fillers (the design of shell can be used for the absorption of the movement within defined parameters, which are determined by the texture of applied material(s)), for increasing the comfort of the equipment or for better refined fitting to the body-shape contour of user. Preferably the flexible bond has to be located hidden in the shell, in order to decrease the risk of injury and keep outside uniformity of the equipment, so it can not catch any object in the environment, but of course this flexible bond can be located on the outer surface of equipment. Our experiments also pointed out that advantageous solution can be to have a flexible bond secure a defined stretching between weight fillers along the equipment in order that the equipment can be more durable or decrease the risk of injury. This function can be accomplished for example by applying an element to prevent overhanging (for example rubber-processed string, or alike which comprises a defined length flexible bond unit between weight fillers towards prevents the overhanging). This element defining overhanging length provides security as it can prevent risk of injury because it prevents the accidental breakage of flexible bond.

Another embodiment, if the equipment could be unjointed into the two same portions such that the opposite ends can be fit in each other and thereby come into being the closed equipment. In this case, the opening/closing section of the neck portion is of similar shape as the opposite opening/closing section of waist region. In this case, the equipment can be adjusted to different size with more than one joining units, which are located the opposite end of equipment relative to the end where the weight filler can be put into the shell and the connection is made using the connection unit which is located the closer to the end of equipment where the weight filler can be put into the shell. The two symmetrical parts can be configured so that it has such a point at the opposite end of the opening/closing section wherein the two parts can be joined to each other with an undetachable or detachable bonding. The undetachable bonding may be for example sewing or gluing, while the detachable bonding may be for example Velcro, zippers, snaps, buckles, buttons and these bonds have elastic properties too. The opening/closing section of occiput preferably has a solution for removable bonding so that they can be made into two same or near same equipments which we can be used for new type of movements.

The primary use of equipment is when it is located on the upper body of the user, wherein the equipment starts from the opening/closing section which is located near the occiput. The part of the equipment towards the chest and at outside of the chest silhouette has to go under armpit of the user and rest of the equipment located on the back part of user preferably in regions located above the kidneys. The equipment can be placed on the waist, arms or legs during other forms of use. Also in these cases, the equipment can be used as the extra weight on the body and improve the vitality of body. Another embodiment when the equipment is detached in two same symmetrical parts then they can be located as same extra weights on the twin body parts accordingly if located the symmetrical parts of equipment on the two arms or legs than they can be used as a conventional arm or leg dumb-bells. Such use further increases the technical features of the equipment because the traditional arm and leg dumb-bells cannot be located on the upper body and conventional weight vests cannot be located on the arms or legs with similar comfort. In case the flexible bond is located between connecting of the weight fillers, than additional practices can be achieved with equipment similarly as an expander. Of course, the opening/closing section of the neck portion can have flexible properties too. In addition, this flexibility can be created with the material of shell which can be flexible, into which the weight filler is inserted. The weight filler is an integral part of shell which is a further advantage of this solution. Our solution the risk of injury during exercise is reduced and we found other features to the sport equipment.

We realised important technical features during the shaping of equipment that the outer surface of shell does not comprise any catchable part which the user can use as a handle during exercise. Of course, the equipment can be configured with handle either directly or indirectly, such as an external device for example a belt, which has at least one loop wherein can be done a limb. The weight vests, which have pockets on the outer surface, or storage areas (pockets) can mean catch reliefing in some situations for example, doing something which is not original function, furthermore these devices cannot be fitted to the body shape or contour continuously. The catch-free design is advantageous also because this shape reduces chance of injuries by catching objects which are in the environment and assures more comfortable feeling. The weight filler can be inserted through an opening into to the shell which has opening molds into the surface of shell and the opening is designed so that the weight filler cannot slip out during exercise. For example, the shell is comprised of two armil sections and the weight filler is in both armil parts at once or material of shell is tightened on the weight filler but the opening can also be closed with other mechanical devices (buttons, Velcro, zippers, etc.).

The invention is presented according to claim 1-10. in detail.

The invention is presented by the following figures.

FIG. 1. Location of sport equipment on the human body during use.

Figure 2:
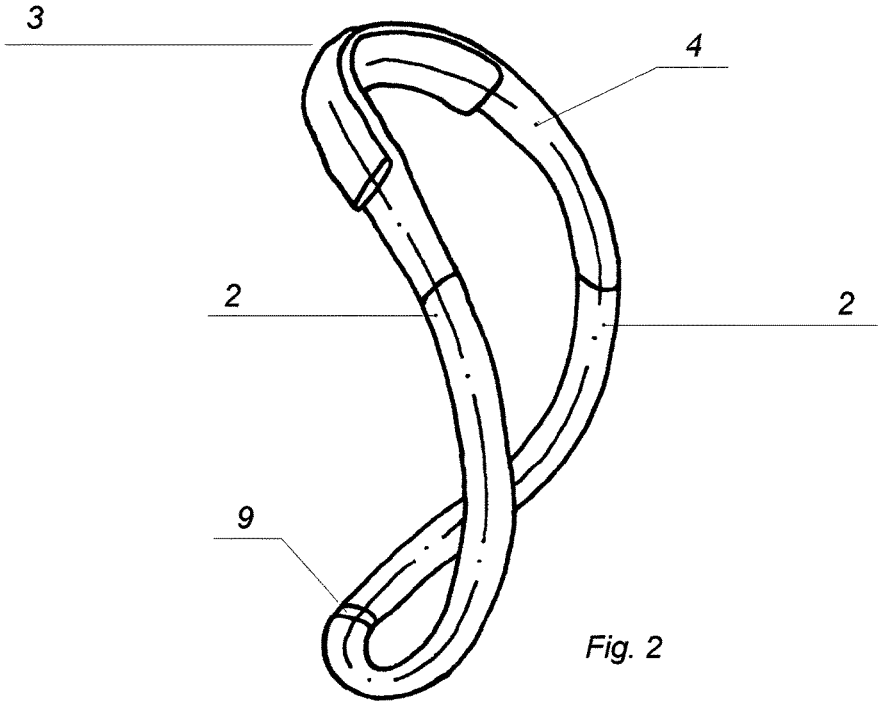

FIG. 2. The equipment is a real appearance during simulated use.

Figure 3:
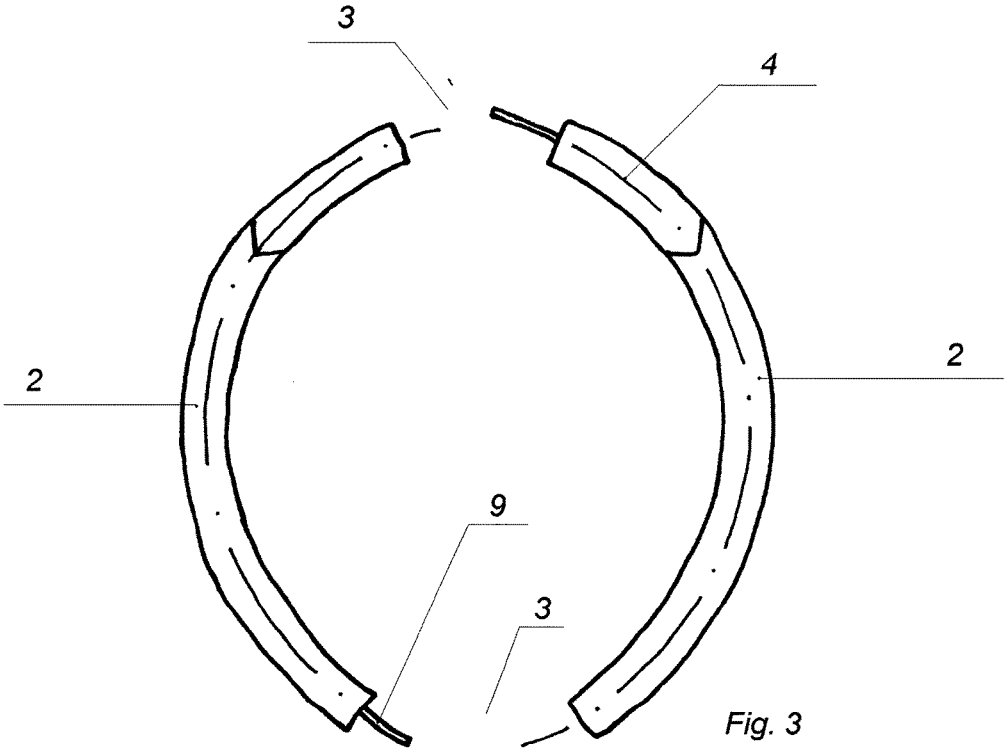

FIG. 3. The two essentially symmetric equipment parts.

Figure 4:
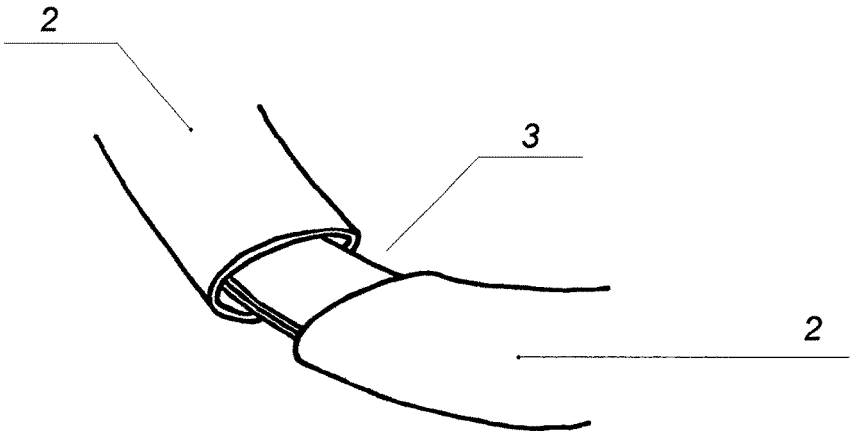

FIG. 4. Embodiment of flexible bond.

Figure 5:
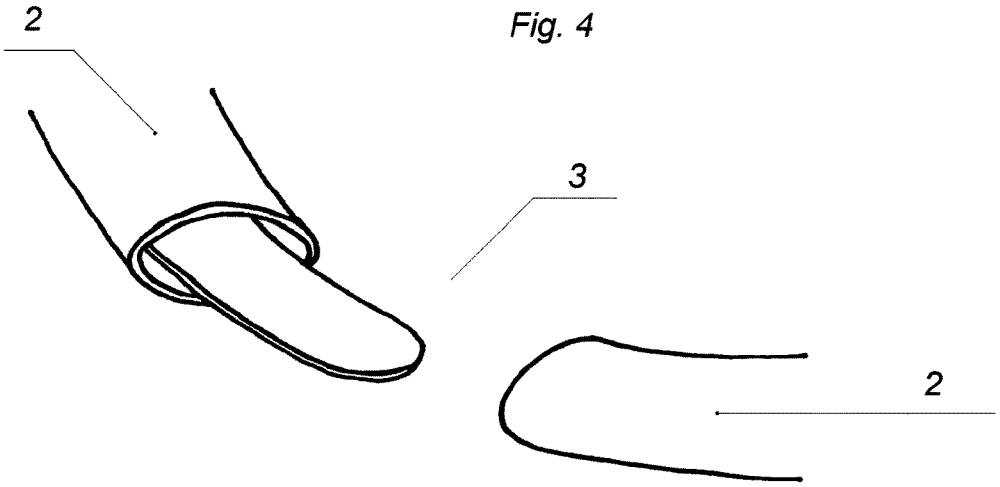

FIG. 5. The flexible bond in an open state.

Figure 6:
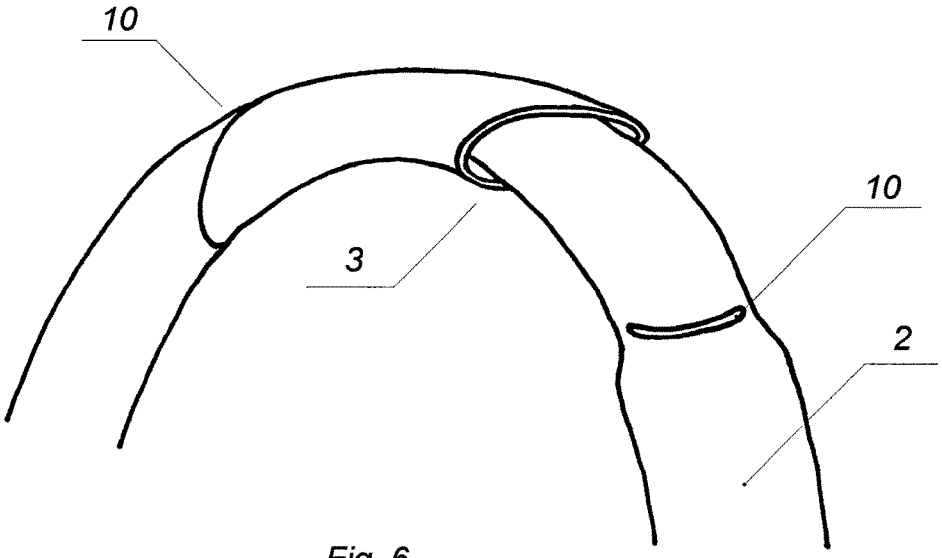

FIG. 6. Embodiment of opening/closing section.

Figure 7:
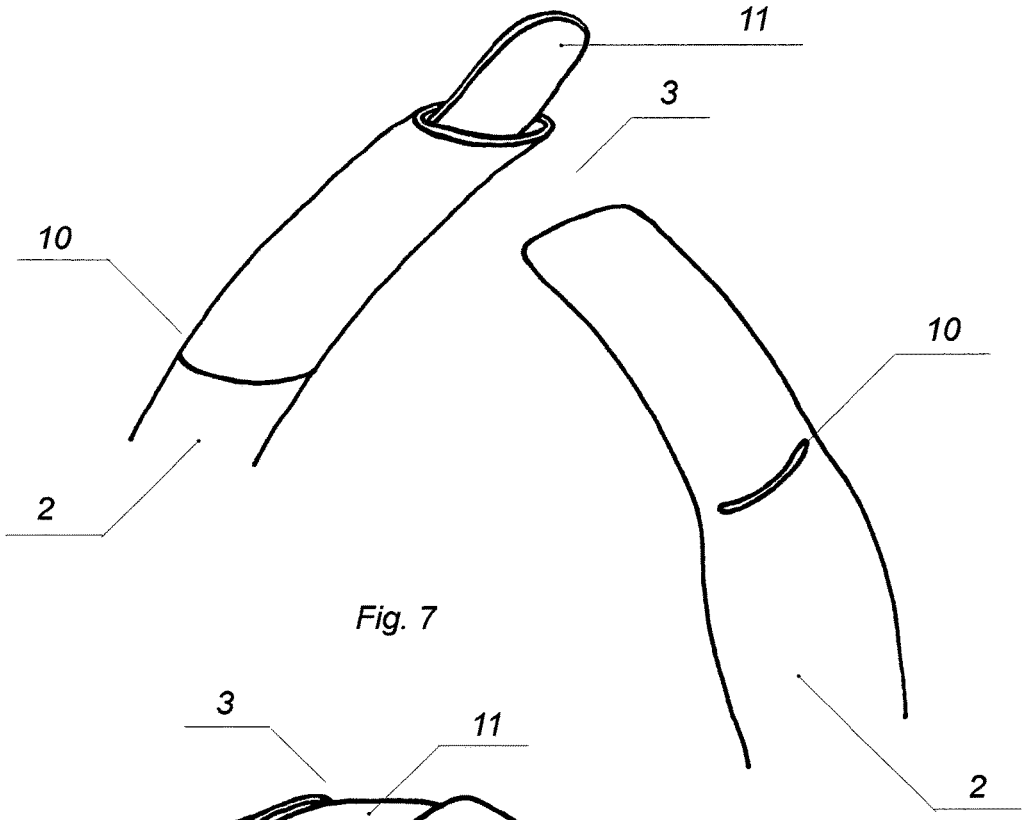

FIG. 7. The opening/closing section in a possible open state.

Figure 8:
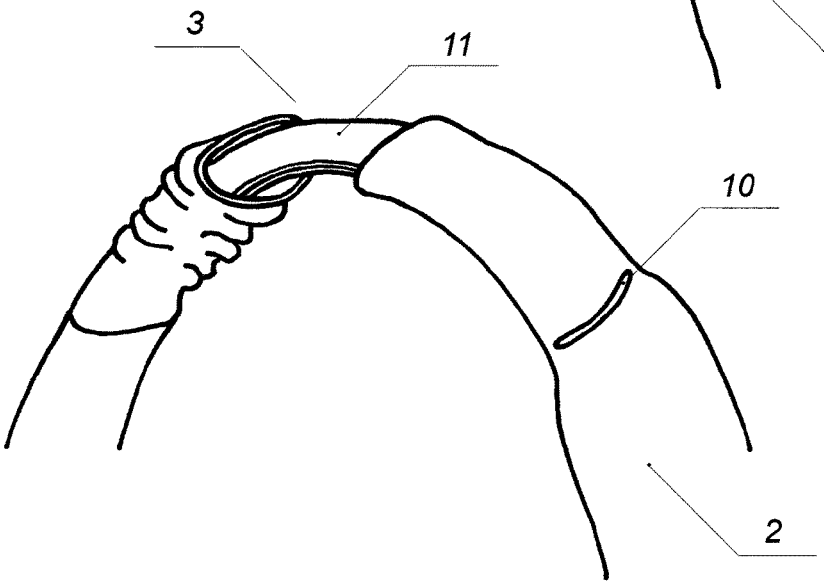

FIG. 8. An embodiment of opening/closing section hiding in the shell.

FIG. 9*a*. Embodiment of two symmetrical unfolded equipment parts.

FIG. 9*b*. Embodiment of opening/closing section of connection.

FIG. 1. shows the equipment in use. It shows well, that part of sport equipment is located back occiput, which does not include 2 weight filler. The 2 weight fillers locates symmetrically in equipment and at least have two pieces of 2 weight fillers, which are located in sections in the flexible 1 shell and these 2 weight fillers are located sequentially in line with 1 shell of 4 longitudinal axis. The rest of equipment is located 6 on the back of the body (back, waist) running around and under the armpits. A 9 flexible bond can be configure between the 2 weight fillers. The center of gravity of the 8 sport equipment is located at 20% of to the body length distance or preferably less away from the user's center of gravity in order to least differ form the human bodys center of gravity in under load.

FIG. 2. shows the closed equipment in a realistic figure, where the 3 opening/closing section is extended to 2 weight fillers which are located symmetrically to each others, which do not contain filler material. The 3 opening/closing section ensures the connection and disconnecting between the two ends of equipment which is shaped to infinity or the snake-like state. The connection can be configured with 9 flexible bond between the two 2 weight fillers, which practically can be hidden into the interior of 1 shell for uniform shape of the equipment. The 9 flexible bond can be comprised longitudinally adjustable 3 opening/closing section too. We can put a safety unit into the 1 shell or on outer surface of the 1 shell tin order to prevent the laping or breakage of the 9 flexible bond, this solution is not shown on the figure.

FIG. 3. shows the equipment, that is substantially separated into two symmetrical portions/sections, where on the 5 occiput part is located the 3 opening/closing section of the 1 shell respectively the 9 flexible bond also has an 3 opening/closing section. Both opposing 3 opening/closing sections are adjustably designed in order to enable the user for personalised setup to the desired length with 3 opening/closing section which located on 5 occiput, while the extent of flexibility can be set by the 9 flexible bond.

FIG. 4. shows a possible embodiment of 9 flexible bond with the two 2 weight fillers, which may be also an 3 opening/closing section too, but is not an exclusive criteria.

FIG. 5. shows a possible opened state which is located between two 2 weight fillers by 9 flexible bond of 3 opening/closing section.

FIG. 6. shows a possible embodiment of 3 opening/closing section which is located by 5 occiput. The adjustable part is located by 3 opening/closing section and it is hidden into the 1 shell. The hiding increases the users comfort and decreases the risk of injury because the adjustable part that is located by 3 opening/closing section cannot catch into anything. In one possible embodiment the 2 weight filler can be inserted and removed through 10 hole into the 1 shell, which is present on both, essentially symmetrical, parts.

FIG. 7. shows the opening state of 3 opening/closing section which is located at 5 back occiput, wherein the user can be set the length of equipment by 11 unit.

FIG. 8. shows how the length adjusting 11 unit of 3 opening/closing section which is located on the 5 occiput can be hidden into the 1 shell to prevent direct contact with user. This is important because it also makes wearing the equipment more comfortable and also reduces the risk of injury.

FIGS. 9*a*. and 9*b*. show an embodiment of equipment where it can be disjoined into two identical parts. On the 1 shell there are configured similar or same 3 opening/closing sections which are located opposing each other, to allow for the separation into two identical parts. The 3 opening/closing sections are configured so that the either end of 1 shell and the other end of 1 shell can be connected each other and so that the user can adjust the length of equipment by both of two ends of equipment with adjustable unit for determined size (for example open end of 14 buckle adapts into the any 15 holes which is located on the adjustable 11 unit of other end of 1 shell). The equipment can also be configured so that the material of 1 shell is flexible and so that the 3 opening/closing sections are not required to include additional flexible link(s). For the symmetrical design, the weight filler can be inserted through the 10 opening into the 1 shell and the equipment will be applied onto the body by the connection of the two same parts. The 10 opening for inserting the 2 weight filler is located closer to either of the ends of 1 shell (practically it is located closer to the 14 buckle and the length adjusting 11 unit which comprises the 15 holes in order to fix the 14 buckle is located on the other end of the 3 opening/closing section further from the 10 opening). Of course, the 10 opening can be configured between the 3 opening/closing section(s) on any part of 1 shell for insert the 2 weight filler. The 2 weight filler which is inserted through the 10 opening can not to slip during use because the 1 shell is comprised of two armil parts, for example a 12 shorter and 13 longer armil parts (the armil parts overlap one another) and the 2 weight filler is located in the both armil parts at once. The location of 10 opening is imaginable with different configuration of the armil parts ratios. Such a 1 shell part can be configured between the 2 weight filler and the 14 buckle or rather the 2 weight filler and length adjusting 11 unit which does not comprise 2 weight filler, importantly of configuration is determined by body of user in order to define the scale of shell section that is without weight filler.

Advantages of the Sport Equipment:

Advantages of the invention are the following. The size of physical fitness equipment is adapted for user in any case in order so the user can correct and the adjust the size of equipment even during in wearing. The equipment encourages the user for correct posture. The 2 weight filler is hidden into the 1 shell, which reduces the risk of injury. The outside surface of 1 shell is configured not to have any handle unit. The wearing of equipment is improving the correct posture and generates discomfort for user during movement than other similar devices with 2 weight filler because both hands can be moved free and it also generates less injuries because it does not contain any handles on the outside surface of 1 shell. It will not be a direct load the joints of limbs. The equipment does not generate any unwanted pressure or tightness on chest. It does not cause unpleasant counter-motion during the using. It causes less discomfort during sweating because it touches on smaller surface of body compared with the other solutions. It has a simple design, low prime cost, safe to use, easy to store and lot of different exercises can be done with it. The equipment draws together and accomplishes the advantageous properties of presently known similar solutions and reduces the risk of injury, furthermore some different type of movement can be performed with only one equipment.

The invention claimed is:

1. A sport equipment to improve physical fitness of a user, the sport equipment having an open state with a snake-like shape and a closed state with a loop-like shape, the sport equipment having a longitudinal axis (4) extending along the snake-like shape in the open state and along the loop-like shape in the closed state, the sport equipment further comprising at least a partially closed flexible shell (1) with uniform outer surface of catch-free design defining said snake-like shape, a weight filler (2) in bulk arranged within the shell (1) along and in parallel with the longitudinal axis (4), and at least one opening/closing section (3) adjustable in length along the longitudinal axis (4), the opening/closing section (3) of the sport equipment is configured to provide the loop-like shape of endless construction to said sport equipment in the closed state; wherein the loop-like shape of the equipment in the closed state corresponds to a 3-dimensional out-of-plane space curve when fitting the equipment around a spinal line of the user's body, the weight filler (2) is arranged in sections along the direction of the longitudinal axis (4) of the equipment, said weighted sections located symmetrically along the longitudinal axis (4) of the equipment and apart from the opening/closing section (3).

2. The equipment of claim 1, wherein the longitudinal axis (4) of the equipment in the closed state runs from the back occiput (5) of the user's body and under armpits of the user's body when fitting the equipment around the spinal line of the user's body.

3. The equipment of claim 1, comprising two sections of weight fillers (2) with a flexible bond (9) therebetween.

4. The equipment of claim 3, wherein the flexible bond (9) comprises a second opening/closing section (3) adjustable in length.

5. The equipment of claim 1, wherein the equipment is essentially made of two identical mirrored halves.

6. The equipment of claim 5, wherein the weight fillers (2) in the two halves are of the same volume.

7. The equipment of claim 1, wherein the weight filler (2) is sand, gravel, balls, pellets, granules, powder, gel, liquid, or a mixture thereof.

8. The equipment of claim 1, wherein the shell (1) is provided with an opening (10) configured to insert the weight filler (2) into the shell (1).

9. The equipment of claim 8, wherein the shell (1) is formed as two armil parts (12, 13) adapted to overlap one another in the region where the opening (10) is located to hinder the weight filler (2) from slipping out of the shell (1) in the closed state.

10. The equipment of claim 1, wherein the 3-dimensional out-of-plane space curve, in the closed state, essentially corresponds to the contour of a sewing line of a baseball ball.

11. A method for increasing and/or maintaining physical fitness of a human user, said method comprising the human user wearing the equipment of claim 1 in the closed state of the equipment on the user's upper body with the opening/closing section near the user's occiput, and the weight filler extending over and in front of the user's shoulders and behind the back of the user.

12. The method of claim 11, wherein the equipment is located on the back of the user in regions above the user's kidneys.

13. The method of claim 11, wherein the weight filler is worn symmetrically on the user's body by spinal line of the user.

14. The method of claim 11, wherein the equipment is worn by the user during exercise.

15. The method of claim 11, wherein a distance between the center of gravity of the equipment and the user's center of gravity is at 20% or less than the user's body height.

* * * * *